United States Patent [19]

Johnson

[11] 4,295,334

[45] Oct. 20, 1981

[54] PARAMETRIC ENERGY CONVERTER

[76] Inventor: Richard N. Johnson, 14411 Quince Orchard Rd., Gaithersburg, Md. 20760

[21] Appl. No.: 99,368

[22] Filed: Dec. 3, 1979

[51] Int. Cl.[3] ..... F01K 11/02

[52] U.S. Cl. ..... 60/669

[58] Field of Search ..... 60/669, 670, 651, 671

[56] References Cited

U.S. PATENT DOCUMENTS 2,075,648 3/1937 Huttner ..... 60/669

3,312,065 4/1967 Guin ..... 60/669

*Primary Examiner*—Allen M. Ostrager

*Attorney, Agent, or Firm*—Nathan Edelberg; Robert P. Gibson; Saul Elbaum

[57] ABSTRACT

A method and apparatus for converting thermal energy into mechanical energy by parametric pumping of rotary inertia. In a preferred embodiment, a modified Tesla turbine rotor is positioned within a rotary boiler along its axis of rotation. An external heat source, such as solar radiation, is directed onto the outer casing of the boiler to convert the liquid to steam. As the steam spirals inwardly toward the discs of the rotor, the moment of inertia of the mass of steam is reduced to thereby substantially increase its kinetic energy. The laminar flow of steam between the discs of the rotor transfers the increased kinetic energy to the rotor which can be coupled out through an output shaft to perform mechanical work. A portion of the mechanical output can be fed back to maintain rotation of the boiler.

10 Claims, 3 Drawing Figures

PARAMETRIC ENERGY CONVERTER

RIGHTS OF THE GOVERNMENT

The invention described herein may be manufactured, used, and licensed by or for the United States Government for governmental purposes without payment to me of any royalty thereon.

BACKGROUND OF THE INVENTION

1. Field of the Invention

The present invention is related to energy conversion devices and techniques, and, more particularly, is directed toward a method and apparatus for efficient conversion of thermal energy into mechanical energy.

2. Description of the Prior Art

Many practical embodiments of heat engines are known. Each, however, suffers from several deficiencies which reduce their efficiency or make them difficult and expensive to manufacture.

Generally, the flow of fluids in channels defined by solid walls becomes turbulent for large Reynold's numbers which results in a loss of energy via internal friction in the fluid. One example is pipes that conduct gas from the boiler to the engine, which pipes are necessitated by the physical separation of the two devices when a conventional water level boiler is used. Another example would be pumping losses that occur in a monotube boiler when such means are utilized to improve heat transfer from combustion gases to liquid in a small boiler. If a rotary boiler is used to improve heat transfer from combustion gases to the working fluid in a small boiler, both pipe losses and pumping losses occur. Another example occurs in conventional turbines, where the use of nozzles and impulse buckets results in much lossy turbulence. Further, losses occur in the stator channels of axial flow turbines.

A particular kind of rotary turbine known as the Tesla turbine employs a plurality of substantially planar, parallel discs between which fluid is directed. This turbine, invented by Nikola Tesla and described in his U.S. Pat. Nos. 1,061,142 and 1,061,206, has received some attention in the recent literature. See, for example: "An Analytical and Experimental Investigation of Multiple-Disk Turbines," W. Rice, *Journal of Engineering for Power,* Transactions of the ASME, January 1965, pages 29–36; "Investigation into the Performance Characteristics of a Friction Turbine," E. W. Beans, *J. Spacecraft,* Volume 3, No. 1, January 1966, pages 131–134; "Calculated Design Data for the Multiple-Disk Turbine Using Incompressible Fluid," M. J. Lawn, Jr. and W. Rice, *Journal of Fluids Engineering,* Transactions of the ASME, September 1974, pages 252–258; and "An Integral Solution for Compressible Flow Through Disc Turbines," C. E. Bassett, Jr., *IECEC '75 Record,* pages 1098–1106.

Unfortunately, the conventional Tesla turbine also suffers from turbulent losses which exist at both the input and output of the turbine due to the use of input nozzles and the spider-mounted shaft discs. There are also losses which results from "scrubbing" of the peripheral casing in both Tesla and conventional radial inflow turbines. End wall coupling to Tesla turbines is also a problem.

The high technology necessary to overcome the above-mentioned deficiencies in both conventional and Tesla turbines results in very expensive structures. For example, the pipes which conduct gas from the boiler to the engine must have smooth, uninterrupted interior surfaces to minimize losses, and must be thermally insulated. In a rotary boiler, there is a need for high temperature, high pressure rotary joints at the input and output. In an impulse bucket type of conventional turbine, the buckets must be shaped from refractory materials, and their attachment to the turbine wheel is difficult. Further, achievement of a low leakage fit between the rotor and stator is difficult in conventional turbines. In the Tesla turbine, the exhaust passages in the spider portion introduces weakness at the point of greatest stress, and upsets the flow at the greatest fluid/turbine relative velocity.

The foregoing deficiencies can be further appreciated if one considers the losses involved if one were to utilize a conventional rotary boiler to drive a conventional Tesla turbine. In such a system, a liquid is fed to the rotary boiler where heat is added. The kinetic energy of the liquid is raised by the rotary drive to the boiler and, after heat is added, the resultant gas spirals in toward a central exit pipe, gaining even more kinetic energy. A pipe connects the output from the boiler to the input of the Tesla turbine rotor. All of the kinetic energy thus generated in the boiler is now dissipated, and the turbulent flow of gas through the connecting pipe causes further losses. At the end of the connecting pipe, there is positioned a nozzle as the input conduit to the turbine whose purpose is to convert stagnation pressure into kinetic energy. The resultant gas jet, by scrubbing against the wall of the turbine casing and warming it considerably (resulting in further losses) travels a radial inward path through the discs of the conventional Tesla turbine. After considerable radial travel through these discs, a laminar flow condition exists and the kinetic energy of the gas begins to couple to the turbine rotor. At a further inward distance, laminar flow ceases, and further losses are incurred, until the exit holes or supporting spider structure are encountered, at which point turbulence becomes quite extreme, thereby warming the turbine shaft.

It may therefore be appreciated that considerable energy is lost in the conventional systems as set forth above, and it would be extremely desirable if a system for converting heat energy to mechanical energy could be devised which eliminates or substantially reduces such losses. It is toward achieving this end that the present invention is advanced.

OBJECTS AND SUMMARY OF THE INVENTION

It is therefore a primary object of the present invention to provide a method and apparatus for converting thermal energy into mechanical energy which overcomes the dificiencies noted above with respect to the prior art.

Another object of the present invention is to provide a new and improved system for converting thermal energy into mechanical energy which greatly reduces boiler kinetic energy losses, pipe losses, nozzle conversion losses, and scrubbing losses inherent in the prior art systems.

A further object of the present invention is to provide a system for converting thermal energy into mechanical energy which obviates the need for high pressure, high temperature rotary joints as well as other expensive, high technology structures.

An additional object of the present invention is to provide a system for converting thermal energy into mechanical energy which takes advantage of the reduction in the moment of inertia of a mass to produce useful mechanical output.

An additional and important object of the present invention is to provide a system for converting thermal energy into mechanical energy at high efficiency, which system is of simple construction and may be manufactured from readily available, low-cost components.

The foregoing and other objects are attained in accordance with one aspect of the present invention through the provision of a parametric energy converter which comprises a housing having a mass positioned therewithin, means for rotating the housing about a center of rotation, means for heating the mass for causing the mass to move toward the center of rotation, and means positioned at the center of rotation for extracting the resultant kinetic energy of the mass. The housing more particularly comprises a substantially cylindrical rotary boiler, while the mass comprises water which is converted into steam in response to the heating means. The rotary boiler more particularly may include a substantially cylindrical outer wall against the inside surface of which the water is compressed when the boiler is rotated, a top wall and a bottom wall which substantially enclose the ends of the boiler, and an intermediate wall which defines and separates an upper portion and a lower portion of the boiler.

In accordance with more detailed aspects of the present invention, the energy extracting means includes rotor means positioned in the upper portion of the boiler and adapted to be rotated by the steam, and further comprising means positioned externally of the boiler for coupling out the rotary motion of the rotor means. The rotor means more particularly comprises a plurality of substantially planar, parallel discs positioned concentrically about the center of rotation and adapted to receive the steam between adjacent discs at the periphery thereof. The discs include means positioned at the central portion thereof for exhausting the steam to the lower portion of the boiler. The lower portion of the boiler more particularly includes means for condensing the steam back into water, and further comprises aperture means positioned in the intermediate wall for feeding the water to the upper portion of the boiler after condensation.

In accordance with other aspects of the present invention, there is further provided means for supporting the rotary boiler for rotating about the center of rotation, the supporting means including means for introducing cooling air around the lower portion of boiler and means for insulating the upper portion from the lower portion. The supporting means includes a window means positioned adjacent the upper portion of the boiler for admitting solar radiation, which solar radiation comprises the means for heating the mass in the boiler. The supporting means includes a wall that surrounds the boiler which preferably has a reflective surface on the inside surface thereof.

In accordance with another aspect of the present invention, means are preferably coupled between the output shaft of the rotor and the housing for further rotating the housing. A start motor may be provided for initially rotating the housing, and clutch means may be provided for disengaging the start motor after the housing has started rotating.

In accordance with another aspect of the present invention, there is provided a method of converting heat energy into mechanical energy, which comprises the steps of rotating a body having a mass positioned therein, heating the mass for causing the mass to move toward the center of rotation of the body, and extracting the resultant kinetic energy of the mass at the center of rotation. The heating step includes the step of converting the mass from a liquid state to a vapor state, and the extracting step preferably includes the step of positioning a plurality of substantially planar, parallel discs at the center of rotation for receiving the vapor mass between adjacent discs at the periphery thereof, and coupling the resultant rotary motion of the discs to an output shaft. The rotating step may include the step of coupling the rotary motion of the output shaft to the body for rotating same, while the heating step may include the step of directing solar radiation onto the body for heating the mass.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which.

DETAILED DESCRIPTION OF THE PREFERRED EMBODIMENT

Figure 1:
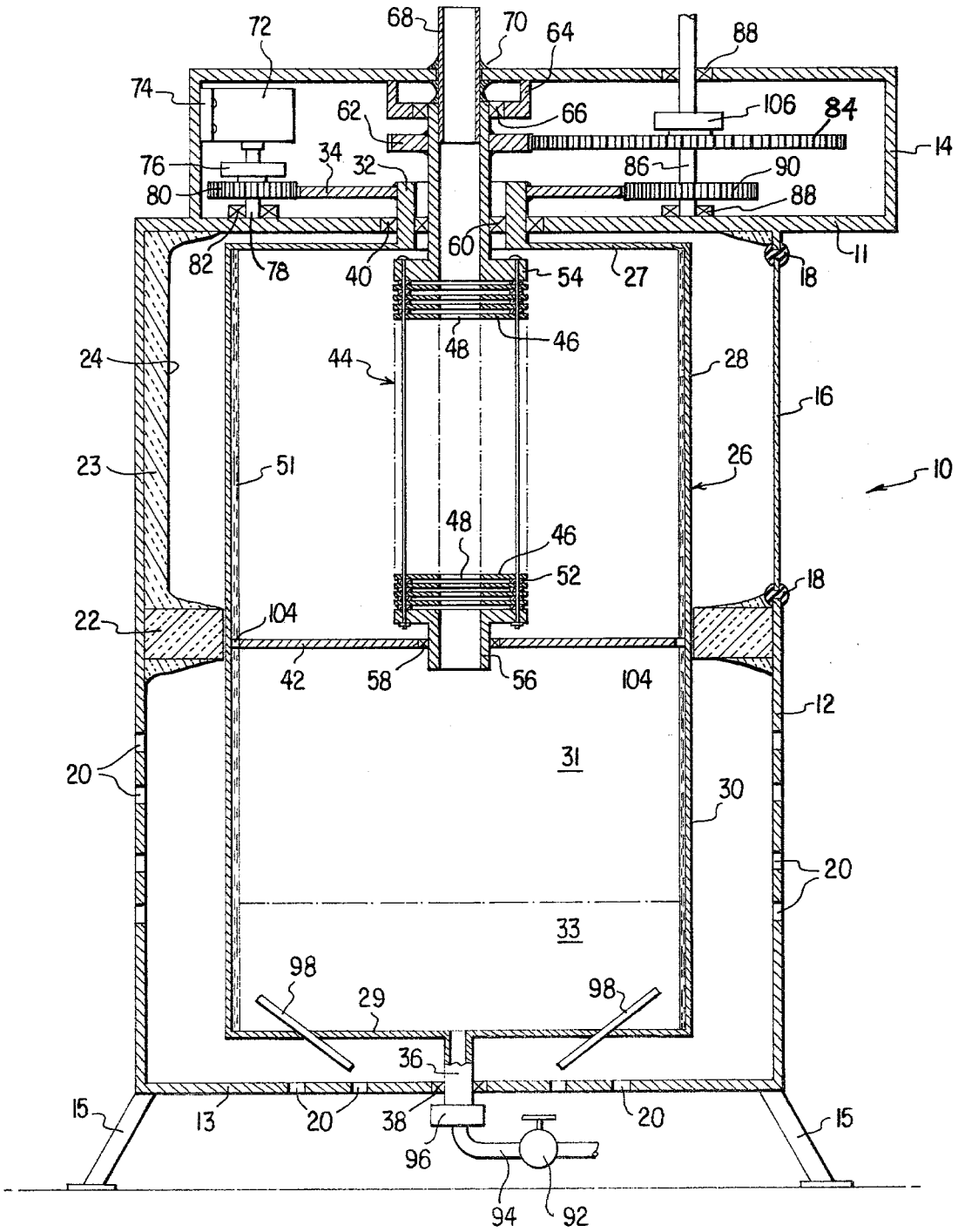
FIG. 1 is a vertical sectional view of a preferred embodiment of the present invention.

When a mass rotates about a center at a given radius, its moment of inertia is proportional to the square of the radius at which it is rotating. The present invention takes advantage of the physical phenomena that when the radius of the rotating mass is reduced, thereby reducing the moment of inertia of the mass, the energy the mass possesses is amplified. In other words, the energy that is possessed by the mass is inversely proportional to its moment of inertia.

In the present invention, the amplified energy is extracted as mechanical energy, and the energy utilized to reduce the moment of inertia is heat energy. Therefore, the present invention, in converting heat energy into mechanical motion by changing a parameter known as the moment of inertia comprises a parametric energy converter. The heat energy changes the parameter (the moment of inertia), and the increased energy may be extracted by loading down an output shaft. As will be apparent to a person of ordinary skill in the art, the precise nature of the heat energy input to the device may take many different forms, and the mechanical energy extracted via an output shaft may be utilized to perform any desired work.

In a preferred embodiment, the present invention takes advantage of the known characteristics of a rotary boiler, and a slightly modified Tesla turbine rotor, and couples them in such a fashion so as to minimize losses normally associated with their combined operation. In the present invention, the conventional connecting pipe from the output of the boiler to the input of the turbine is eliminated, as is the input nozzle to the turbine. Instead, a modified Tesla turbine rotor is positioned within and along the rotating axis of the boiler. The liquid on the outer periphery of the boiler is given some kinetic energy, and heat is added, preferably from a solar collector. The resultant gas within the boiler has precisely the flow characteristics required to enter the Tesla turbine. By proper placement of the peripheral structural supports of the turbine rotor, zero relative tangential velocity of the gas and the supports can be achieved, thereby minimizing any variation to the desired laminar flow. Further, prior art losses of boiler kinetic energy, pipe flow, nozzle conversion and scrubbing of the casing, as well as high pressure, high temperature rotary joints, are eliminated.

Referring now to the drawings, wherein like reference numerals represent identical or corresponding parts throughout the several views, a preferred embodiment of the parametric energy converter of the present invention is indicated generally by reference numeral 10. The device 10 comprises an outer housing or support structure 12 which is preferably substantially cylindrical and includes a top wall 11 and a bottom wall 13. The housing 12 may be supported on the ground or support surface by suitable legs 15.

Mounted on top of housing 12 is a gear case 14 which houses the input and output gearing, to be described in greater detail hereinafter, for the device 10.

Installed on one side of housing 12 in the upper half thereof is a substantially planar glass window 16 supported by molding 18. Window 16 is designed to be transparent to solar radiation, which is the preferred form of heat energy input to the device of the present invention.

Located about the lower portion of cylindrical housing 12, as well as in the bottom wall 13 thereof, are a plurality of breather holes 20 for conducting cooling air over the lower portion of the device, as will be described in greater detail hereinafter.

Positioned within support housing 12 and indicated generally by reference numeral 26 is a rotary boiler which is preferably constructed of a unitary substantially cylindrical metal drum. Boiler 26 includes a top wall 27 and a bottom wall 29 which substantially enclose the cylindrical structure. A center plate 42 extends across the approximate midportion of boiler 26 and serves to separate and define an upper portion 28 and a lower portion 30. Upper portion 28 of boiler 26 may be referred to as the parametric converter portion of boiler 26, whereas the lower portion 30 below plate 42 includes a regenerator area indicated generally by reference numeral 31 below which is located a condenser area indicated generally by reference numeral 33. The center plate 42 also includes a plurality of bleed holes 104 uniformly distributed about the periphery thereof, for a purpose which will become more clear hereinafter.

An annulus of fiberglass insulation 22 is mounted to the inside wall of outer support housing 12 and extends inwardly quite close to the outer wall of boiler 26. Insulation 22, which may comprise fiberglass, for example, is provided for thermally insulating the relatively hot upper portion 28 of boiler 26 from the relatively cool lower portion 30.

Disposed about the inner surface of cylindrical housing 12, adjacent the upper portion 28 of boiler 26, is a layer of insulation 23 over which is preferably positioned a reflective coating 24. The reflective coating 24 is provided to reflect any heat energy emanated from upper portion 28 back onto the wall of the boiler, while insulation 23 acts to prevent excess heat loss.

Extending from the top wall 27 of boiler 26 through the top wall 11 of housing 12 is a hollow shaft 32 having a gear 34 secured thereto. Shaft 32 is journalled in a bearing and/or shaft seal 40 in top wall 11.

Extending from the lower wall 29 of boiler 26 through the lower wall 13 of housing 12 is a hollow shaft 36 which is journalled for rotation within a bearing 38.

Figure 3:
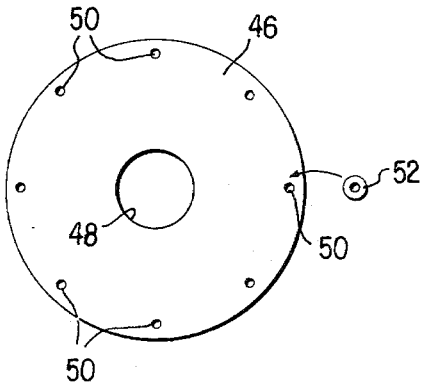
FIG. 3 is a plan view of a typical turbine disc of the preferred embodiment of FIG. 1.

Located along the rotational axis of boiler 26 within the parametric converter portion 28 is a means for extracting the kinetic energy of the mass developed by the rotating boiler which is preferably in the form of a modified Tesla turbine rotor indicated generally by reference numeral 44. Rotor 44 comprises a plurality of substantially planar, parallel discs 46 (See FIG. 3), each of which has an aperture 48 positioned in the center thereof. The aligned apertures 48 of discs 46 serve as an exit orifice for spent steam, in a manner to be described hereinafter. The discs 46 are connected by a plurality of bolts positioned through mounting holes 50 located about the periphery of each disc. Spacers or washers 52 are positioned between adjacent discs 46 to provide a radial flow path for the entering steam between adjacent discs. In a typical application, from 300–500 discs may be provided at a spacing of approximately 0.005 inch.

From the top of the rotor 44 extends an upper hollow shaft 54 which is rotatably supported within a bearing 60 positioned between shaft 54 and shaft 32. A lower hollow shaft 56 extends from the lower portion of rotor 44 and is rotatably supported within bearing 58 mounted in an aperture formed in the central portion of plate 42.

Upper shaft 54 extends into gear casing 14 and has an output gear 62 mounted for rotation therewith. A bearing 66 is held by a mounting bracket 64 connected to casing 14 for maintaining the upper portion of shaft 54 steady.

An optional outlet conduit 68 for residual hot vapor may be connected to the upper wall of gear case 14 via mountings 70. A low friction rotary joint seal is provided in this case between shaft 54 and conduit 68. The output hot vapor through conduit 68 may be utilized for secondary purposes, e.g., home heating or the like, but conduit 68 may be sealed off to make the system of the present invention self-contained.

A start motor 72 may be mounted within gear case 14 via mounting 74. Start motor 72 is preferably coupled through an overrunning clutch 76 to its output shaft 78 journalled in a bearing 82. Mounted on shaft 78 is a starting gear 80 which is adapted to rotate gear 34 of boiler 26.

Output gear 62 of output shaft 54 of rotor 44 is coupled to rotate gear 84 which is mounted upon an output shaft 86. Output shaft 86 is, in turn, journalled for rotation within gear case 14 via bearings 88 and is the shaft from which the output power developed by the present invention may be extracted. An overrunning clutch 106 is peferably mounted about output shaft 86 which allows the start motor 72 to rotate the boiler 26 without causing the rotor 44 to turn.

An auxiliary gear 90 is also mounted for rotation with output shaft 86 and is coupled to rotate gear 34 of boiler 26 after start up has been completed. In other words, gear 90 acts to feed back a portion of the output developed by rotor 44 to continue rotation of the boiler 26.

Below the bottom wall 13 of housing 12 is provided an inlet valve 92 connected to an inlet conduit 94 which is, in turn, mounted in a rotary shaft seal 96 connecting same to lower shaft 36 of boiler 26. Valve 92 and conduit 94 serve as means for inputting water to the boiler 26.

Also, a plurality of angularly disposed heat pipes 98 preferably extend through the lower plate 29 of boiler 26. Heat pipes 98 are preferably arranged in a circumferential array through the bottom wall 29 and serve to increase the heat transfer area for transferring heat from the steam in the condenser area 33 out into the external cooling air which traverses through breather holes 20 around the external wall of lower portion 30.

Figure 2:
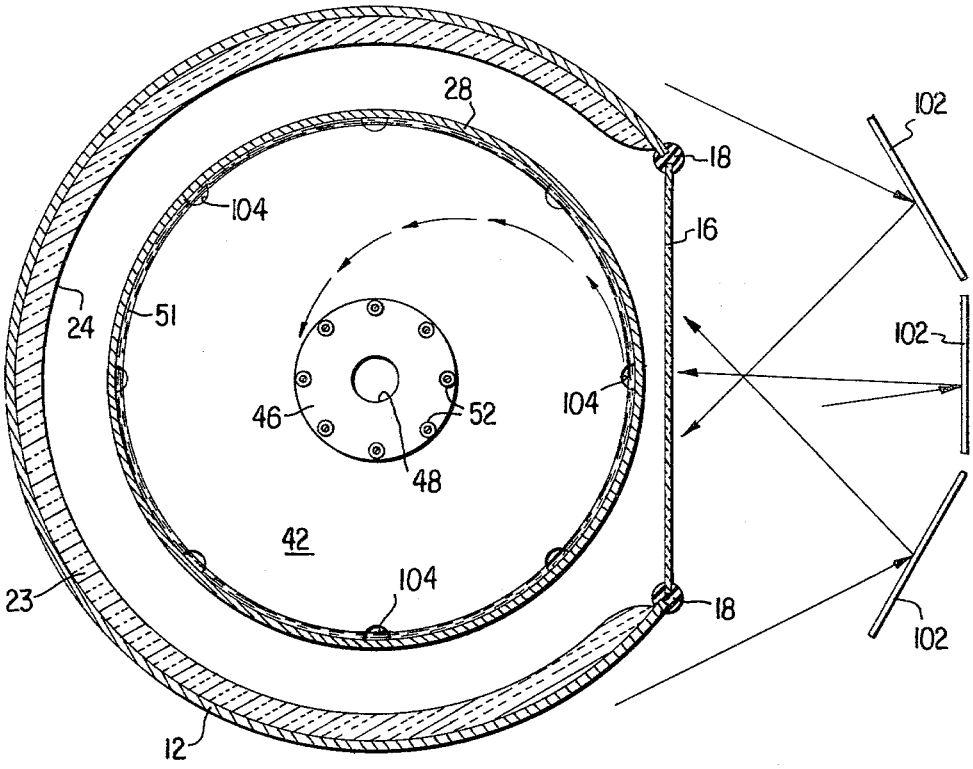
FIG. 2 is a cross-sectional view of the preferred embodiment illustrated in FIG. 1.

As illustrated in FIG. 2, an array of mirrors 102 are preferably provided as a means for collecting and directing solar radiation through the window 16 of housing 12. Mirrors 102 may be appropriately rotated during various times of the day to properly catch and reflect the sun's rays.

Having described the components of the preferred embodiment of the present invention, its operation will now be set forth. Initially, water is introduced into the interior of boiler 26 via inlet valve 92, conduit 94 and shaft 36. The amount of water initially inserted is sufficient to line the inner wall of boiler 26 with approximately a one-quarter inch thick layer of water when the boiler 26 is rotating at its operating angular velocity. To initiate rotation of boiler 26, start motor 72 is actuated which serves to rotate boiler 26 through gears 80 and 34. Overrunning clutch 106, during start up, serves to prevent the energy from start motor 74 from being utilized to rotate rotor 44.

As boiler drum 26 begins to rotate, the centrifugal force generated thereby forces the water against the inner surface of the outer wall. The operating angular velocity of boiler 26 is preferably selected so that the typical force against the liquid layer 51 on the outer wall is at least ten times the force of gravity. Note that the liquid layer 51 is formed along the entire vertical cylindrical wall of both top portion 28 and bottom portion 30 of boiler 26.

The solar radiation directed through window 16 will heat up the water layer 51 all along the periphery of the boiler 26 which is continually rotating. As the water boils and turns into steam, the pressure in the parametric energy portion 28 of boiler 26 builds up to equal the vapor pressure for steam at the temperature. The vapor molecules follow a spiral path, illustrated in FIG. 2, inwardly toward the center of rotation of boiler 26. For an incompressible fluid, the path of the vapor molecules will be a logarithmic spiral. As the steam spirals in toward rotor 44, its moment of inertia goes down since its radius is being reduced. That is, the vapor molecules gain kinetic energy due to conservation of angular momentum. One object of the present invention is to take advantage of this significant increase in kinetic energy, which is accomplished by directing the high energy vapor molecules through the adjacent discs 46 of the turbine rotor 44. For example, the steam may enter the discs 46 at 800–900 feet per second tangential velocity. As the vapor flows through the discs 46 to central outlet 48, its velocity remains very nearly equal to the local tangential velocity of the discs 46 at any point. As the velocity of the steam drops, by being held equal to the local velocity of the discs 46, the kinetic energy of the steam is transferred directly to the discs 46 for rotating same. The kinetic energy, per unit of mass, is equal to one half the square of the tangential velocity and the tangential velocity is equal to the radius times the angular velocity. Since the angular velocity varies as the square of the ratio of the radii, if, for example, the radius of the discs 46 is one quarter that of the radius of the boiler 26, the tangential velocity will be in direct ratio to the radii. So, for example, if the tangential velocity at the outer wall 28 of boiler 26 is 200 feet per second, the tangential velocity of the vapor at the outer periphery of the discs 46 will be 800 feet per second in the given example. Thus, the ratio of the kinetic energy at the entry to the discs 46 to that at the periphery of the wall 28 will be 16:1, in the given example of a radii ratio of 4:1. Since most of the energy that the vapor has as it enters the discs is transferred to the discs, and only one sixteenth of the energy is required to turn the boiler 26, approximately 15/16ths of the energy developed is useful output. The rotary output of rotor 44 is coupled via gears 62 and 84 to rotate output shaft 86. Further, in the given example, if the ratio of radii is 4:1, the gear ratio between gears 90 and 34 will be 16:1 to keep boiler 26 spinning at the right speed.

Assuming that conduit 68 is closed, all of the residual steam or vapor will exit down through central apertures 48 of discs 46 to regenerator section 31. The hottest vapors exiting shaft 56 will contact the liquid layer 51 in the regenerator section 31 of lower portion 30 to preheat the water layer 51 flowing through bleed holes 104. The remaining steam falls to condenser area 33 where the heat pipes 98 in conjunction with cooling air admitted through breather holes 20 combine to cool the vapor down and condense it into water whereupon the centrifugal action of the boiler 26 pumps same back up the side wall into parametric energy section 28 to reinitiate the process. The heat pipes 98 are angled so that the centrifugal force aids the flow of condensed fluid inside the heat pipe to the top where the steam warms it up and turns it into vapor to go back down to be cooled by the condensing air traversing breather holes 20. That is, heat pipes 98 increase the heat transfer area for transferring heat from the steam in condenser area 33 out into the external cooling air.

In the event that conduit 68 is open, some residual hot vapor may be utilized for home heating, or the like, and more water may be inlet through valve 92 and conduit 94 to maintain the cycle of the boiler 26. In the event that conduit 68 is closed off, the system will be self-contained and will not require additional water.

Obviously, numerous modifications and variations of the present invention are possible in light of the above teachings. It is therefore to be understood that within the scope of the appended claims, the invention may be practiced otherwise than as specifically described herein.

I claim as my invention:

1. A parametric energy converter, which comprises:

a housing comprising a rotary boiler having a substantially cylindrical inner and outer wall, a top wall and a bottom wall which substantially enclose the ends of said boiler, and an intermediate wall which defines and separates an upper portion and a lower portion of said boiler;

a fluid mass positioned within said housing;

means for rotating said housing about a center of rotation thereby compressing said fluid mass against said substantially cylindrical inner wall of said boiler;

means for heating said fluid mass for causing said fluid mass to move toward said center of rotation; and means positioned at said center of rotation for extracting the resultant kinetic energy of said fluid mass.

2. A parametric energy converter, as set forth in claim 1, wherein said fluid mass comprises water which is converted into steam in response to said heating means.

3. The apparatus as set forth in claim 2, wherein said extracting means includes rotor means positioned in said upper portion and adapted to be rotated by said steam, and further comprising means positioned externally of said boiler for coupling out the rotary motion of said rotor means.

4. The apparatus as set forth in claim 3, wherein said rotor means comprises a plurality of substantially planar, parallel discs positioned concentrically about said center of rotation and adapted to receive said steam between adjacent discs at the periphery thereof.

5. The apparatus as set forth in claim 4, wherein said discs include means positioned at the central portion thereof for exhausting said steam to said lower portion of said boiler.

6. The apparatus as set forth in claim 5, wherein said lower portion of said boiler includes means for condensing said steam back into water, and further comprising aperture means positioned in said intermediate wall for feeding said water to said upper portion of said boiler.

7. The apparatus as set forth in claim 6, further comprising means for supporting said rotary boiler for rotating about said center of rotation, said supporting means including means for introducing cooling air around said lower portion of said boiler and means for insulating said upper portion from said lower portion.

8. The apparatus as set forth in claim 7, wherein said supporting means includes window means positioned adjacent to said upper portion of said boiler for admitting solar radiation, said solar radiation comprising said means for heating said mass.

9. The apparatus as set forth in claim 8, wherein said supporting means includes a wall which surrounds said boiler, said wall having a reflective coating on the inside surface thereof.

10. The apparatus as set forth in claim 9, wherein said means for rotating said housing comprises a start motor and clutch means for disengaging said start motor after said housing has started rotating.

* * * * *